US006167106A

United States Patent [19]

Hemmelgarn et al.

[11] Patent Number: 6,167,106

[45] Date of Patent: Dec. 26, 2000

[54] APPARATUS AND METHOD FOR COUNTING A SERIES OF PROGRESSIVELY MOVING ARTICLES

[75] Inventors: Gary Lee Hemmelgarn, Kettering; David William Harris, Miamisburg; James Thomas Zalusky, Beavercreek, all of Ohio

[73] Assignee: Hyde Park Electronics, Inc., Dayton, Ohio

[21] Appl. No.: 09/290,470

[22] Filed: Apr. 12, 1999

[51] Int. Cl.[7] ..... G06M 11/00

[52] U.S. Cl. ..... 377/6; 377/10

[58] Field of Search ..... 377/6, 10

[56] References Cited

U.S. PATENT DOCUMENTS

| | | | |
|---|---|---|---|
| 4,026,654 | 5/1977 | Beaurain | 356/5 |
| 4,296,314 | 10/1981 | Dabisch et al. | 235/92 SB |
| 4,356,387 | 10/1982 | Tsubota et al. | 235/92 PK |
| 4,528,679 | 7/1985 | Shahbaz et al. | 377/6 |
| 4,574,368 | 3/1986 | Lipschutz | 367/108 |
| 4,604,735 | 8/1986 | Parsons | 367/93 |
| 4,917,155 | 4/1990 | Koblasz et al. | 141/1 |
| 4,962,538 | 10/1990 | Eppler et al. | 382/1 |
| 5,003,563 | 3/1991 | Passmore | 377/6 |
| 5,005,192 | 4/1991 | Duss | 377/8 |
| 5,241,515 | 8/1993 | Harms et al. | 367/105 |
| 5,672,863 | 9/1997 | Nicks et al. | 250/223 B |

*Primary Examiner*—Margaret R Wambach
*Attorney, Agent, or Firm*—Biebel & French

[57] ABSTRACT

A system for counting a series of progressively moving articles using one or more sidewardly positioned and angularly oriented ultrasonic transducers which bathe the articles with ultrasonic waves and receive echoes reflected backwardly therefrom. Distances to the articles are determined by measuring round-trip sonic travel times. Count adjustment signals are generated when articles pass through the fields of view of the transducers and are replaced by other articles at measurably different distances.

13 Claims, 5 Drawing Sheets

APPARATUS AND METHOD FOR COUNTING A SERIES OF PROGRESSIVELY MOVING ARTICLES

BACKGROUND OF THE INVENTION

This invention relates to the field of article counting and more particularly to the counting of bottles, jars, cans, containers and similar objects being transported along a conveyor. Counting of such articles is complicated by the fact that they tend to back up and reverse direction on the conveyor, so that individual articles become indistinguishable to commonly used sensors. The prior art does include arrangements for counting overlapped sheets, newspaper sections, signatures and the like with the aid of specially positioned ultrasonic transmitters and receivers. However, the positioning of the transmitters and receivers is peculiar to the geometry of overlapped sheet-like articles. Such counting systems are not entirely suitable for counting irregularly shaped and variously spaced articles traveling in an upright orientation along a conveyor. An example of such a counting system appears in Duss U.S. Pat. No. 5,005,192.

The prior art also includes counting systems having inductive proximity sensors which may be placed in pairs on the same side of a pass line or on opposite sides thereof. The two sensors are offset for performing a quadrature count. These sensors are suitable only for counting metallic articles. Also, whenever the article size is changed the sensors must be realigned.

Yet other prior art uses pairs of optical sensors which are laterally separated by a distance equal to half the diameter of articles being sensed, so that a given article is sensed by both sensors sequentially and at different times before another article is sensed by either sensor. Again, the sensors must be realigned upon changes of article size.

It is therefore seen that there is a need for an improved apparatus and method for counting progressions of variously positioned articles of arbitrary construction which may start, stop and reverse their direction of movement.

SUMMARY OF THE INVENTION

The present invention provides an improved apparatus and method for counting a series of progressively moving articles. It involves the use of an offset, directional and angularly oriented, sonic transducer which bathes the articles with pulsed sonic energy and receives echoes reflected backwardly therefrom. A system clock provides a measurement of the round-trip sonic travel time, which is proportional to the distance between the transducer and a target positioned within the transducer's field of view. As a target article passes through the field of view, there is a progressive change in the measured travel time. This is followed by an abrupt change in the travel time when a new target enters the field of view. This invention contemplates the use of that change to trigger an incrementation of a count maintained in a count register.

Preferably, the invention utilizes a pair of such transducers, facing an article pass line in an inwardly toed arrangement, so that one transducer observes the articles during their approach, while the other views them as they depart. Accordingly the transducers have radiation axes which are directed somewhat toward each other at fixed angles ranging between 10 deg. and 80 deg. from perpendiculars to the article pass line. It has found that best results are obtained when these angles are about 40 deg.

When a progression of moving articles are bathed acoustically by different beams operating at the same carrier frequency, care must be taken to avoid interference at the points of reception. This is done by operating the transducers in an alternately pulsed fashion. Whenever one receiver is active, the other receiver is turned off. Preferably each of the transmitters generates ultrasonic pulses having a pulse width of about 4 to 16 microseconds with a pulse repetition rate of about 1,000 Hz. The transducers should be operated at an ultrasonic frequency which is heavily attenuated in air. The required amount of the attenuation depends upon the power of the transmitters and the sensitivity of the receivers. In particular a sonic burst from one transducer should be attenuated sufficiently that it is below the detectable level before the next burst from the other transducer (about one millisecond).

It is a feature of the invention that the distance to an article is known at a series of closely spaced times. This makes it possible to calculate the radial velocity of the article. Also the article moves along a path having a fixed and known offset from the sensor. From that information it is possible to calculate the component of the article velocity in a direction along the path, except for the instant of time while the article lies along a perpendicular from the sensor to the path.

Article velocity information has many uses and is a collateral benefit of the invention.

DESCRIPTION OF THE PREFERRED EMBODIMENTS

Figure 1:
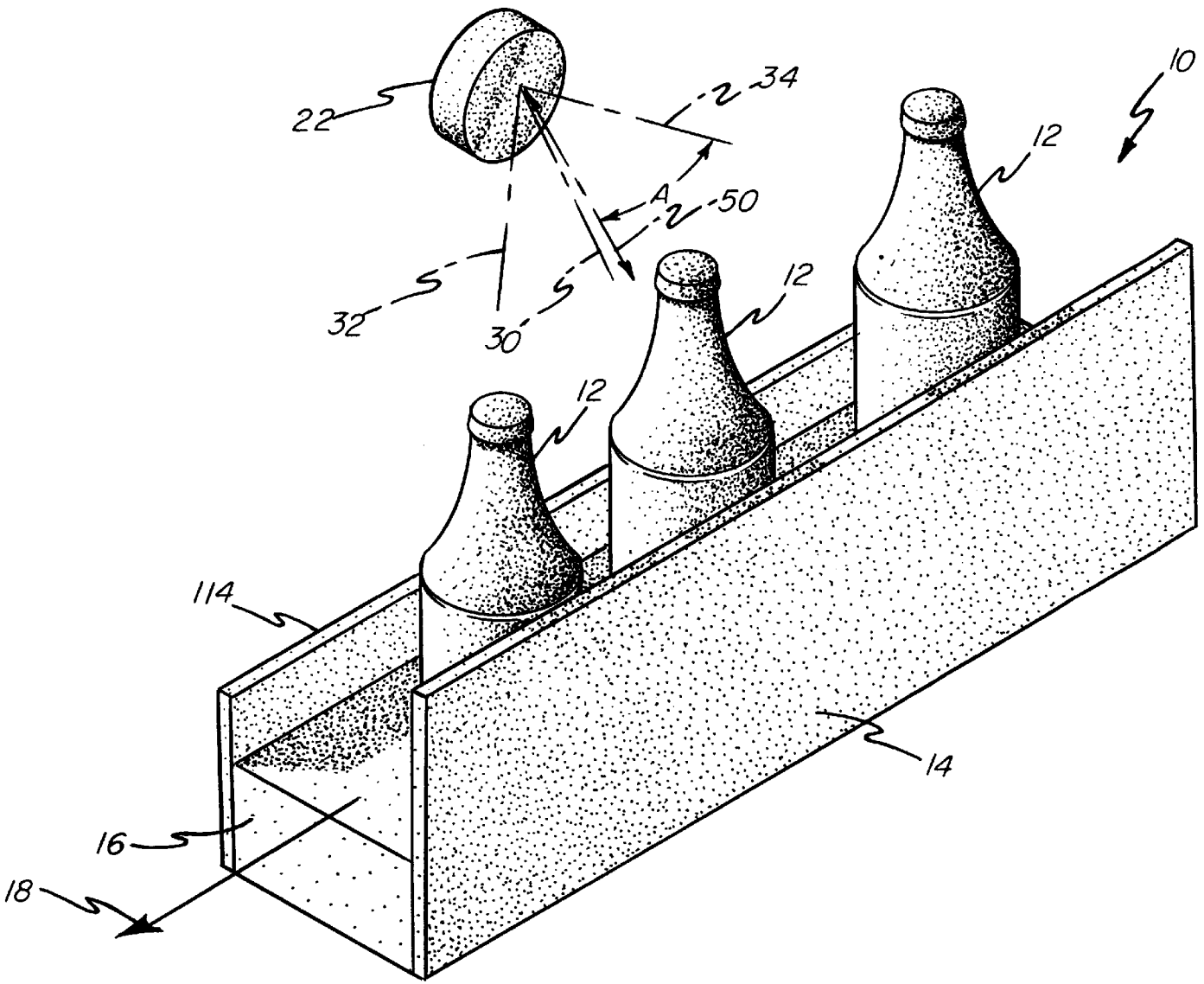
FIG. 1 is a perspective drawing of an ultrasonic sensor positioned in accordance with the present invention for counting a series of moving articles.

FIG. 1 illustrates the invention in its simplest form, employing a single ultrasonic transducer. Thus the invention contemplates a conveyor 10 carrying a series of articles 12. Conveyor 10 has a pair of sidewalls 14, 114 and a moving belt 16 traveling in a direction as indicated by an arrow 18. An ultrasonic transducer 22 is positioned above conveyor 10 as indicated by a coordinate system having a vertical axis 30 and horizontal axes 32, 34. Transducer 22 directs a beam of ultrasonic energy along a line 50. The line 50 is in a horizontal plane above front sidewall 114. The coordinate axis 34 is perpendicular to the direction of travel of containers 12, and the direction line 50 makes an angle A with this axis. Preferably the angle A may be about 40 degrees, but it may have a value anywhere between 10 degrees and 80 degrees or between −10 degrees and −80 degrees. It is significant to note that the beam of transducer 22 may have an angular component in the direction of the arrow 18 or in a direction reversely thereof.

As the articles 12 travel along conveyor 10 they pass through the beam of transducer 22 and reflect echoes backwardly toward their point of origination. These echoes are detected by transducer 22, and the round-trip travel time is measured. This travel time progressively increases or progressively decreases depending upon the sign of the angle A.

Figure 2:
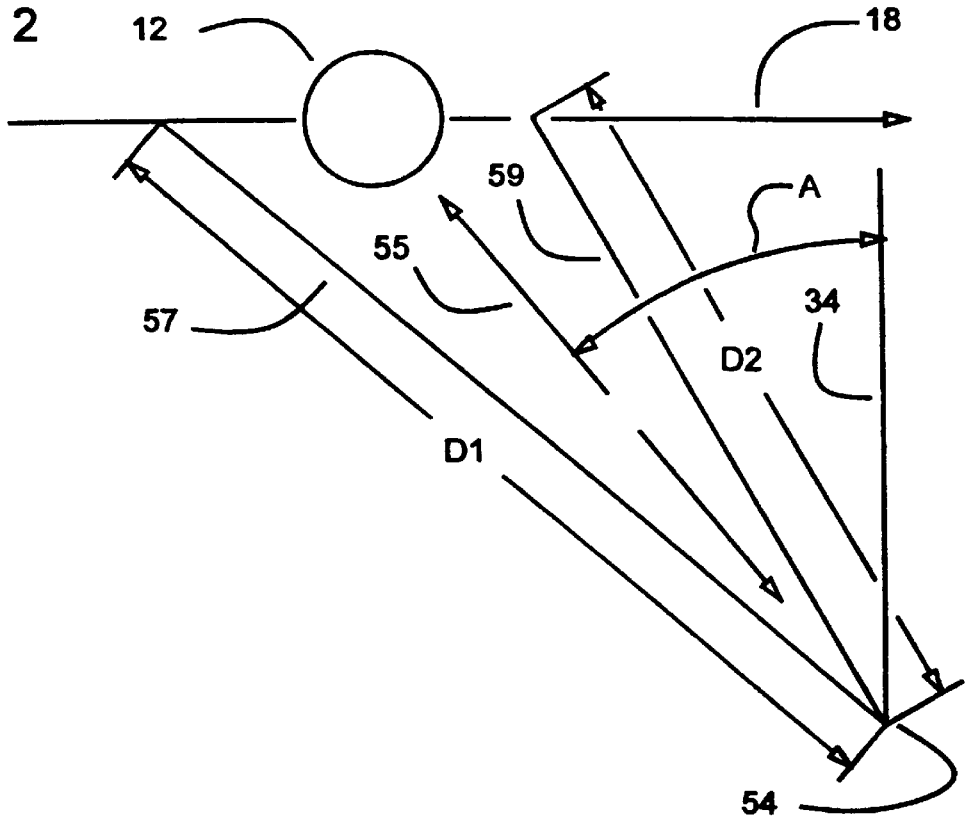
FIG. 2 is a top plan view illustrating positioning geometry for an ultrasonic sensor.
Figure 3:
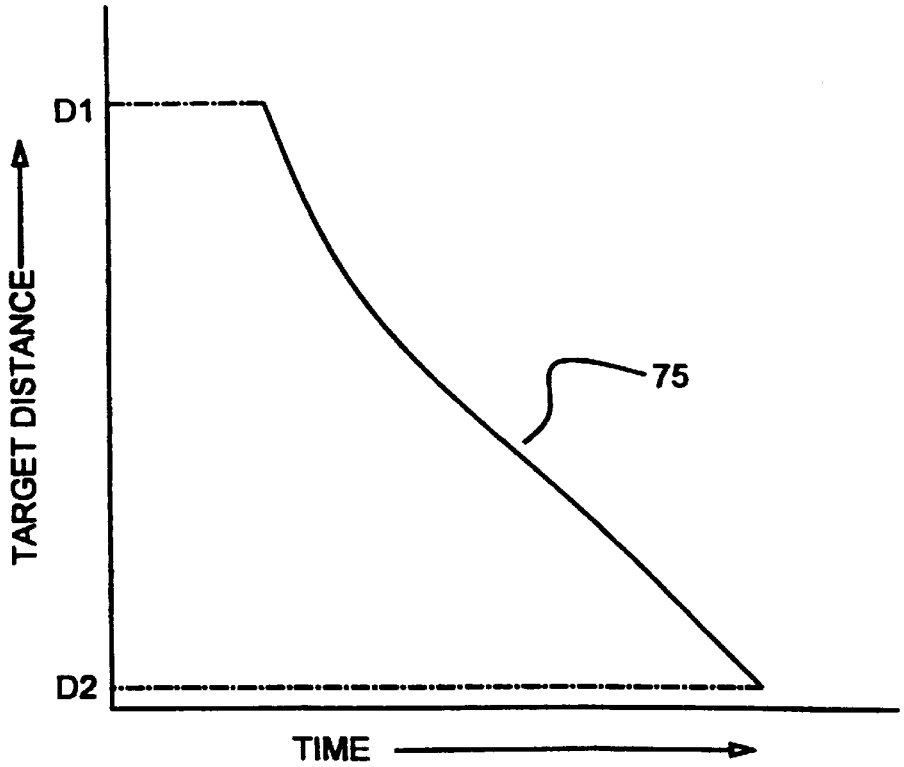
FIG. 3 is a plot of the distance between a moving article and a stationary ultrasonic sensor.

Referring now to FIG. 2, there is shown an article 12 traveling in the direction 18. An ultrasonic transducer (not illustrated) is positioned at a point 54 and generates a beam of ultrasonic energy along a direction line 55 making an angle A with the axis 34. Again, axis 34 is perpendicular to the direction of movement of article 12 The ultrasonic energy traveling in the direction 55 forms a beam as generally indicated by the lines 57, 59. The article 12 is observable by the transducer only while it is between lines 57, 59. Detection occurs when the article crosses line 57, at which time its distance from transducer 12 is D1. Sensing of article 12 ceases at a distance D2 when the article crosses line 59. During the sensing period the distance between article 12 and point 54 decreases progressively as illustrated by FIG. 3. So long as echoes are being detected, the system keeps track of the distance change by a calculation of the form:

$$D_{dif}=D_{new}-D_{old}$$

Normally $D_{dif}$ has a negative value.

If no other article appears before article 12 passes out of visibility, there will be a loss of echo detection. Such a loss of echo, persisting for a predetermined period of time following an echo presence, triggers an incrementation of an article count in a microprocessor (not illustrated in FIG. 2). However, if a new article enters beam 55 before echo loss occurs, $D_{dif}$ goes momentarily positive. This also triggers an incrementation of the article count. It will be appreciated that other abrupt changes in the target distance may be used for initiation of an article count adjustment.

Figure 5:
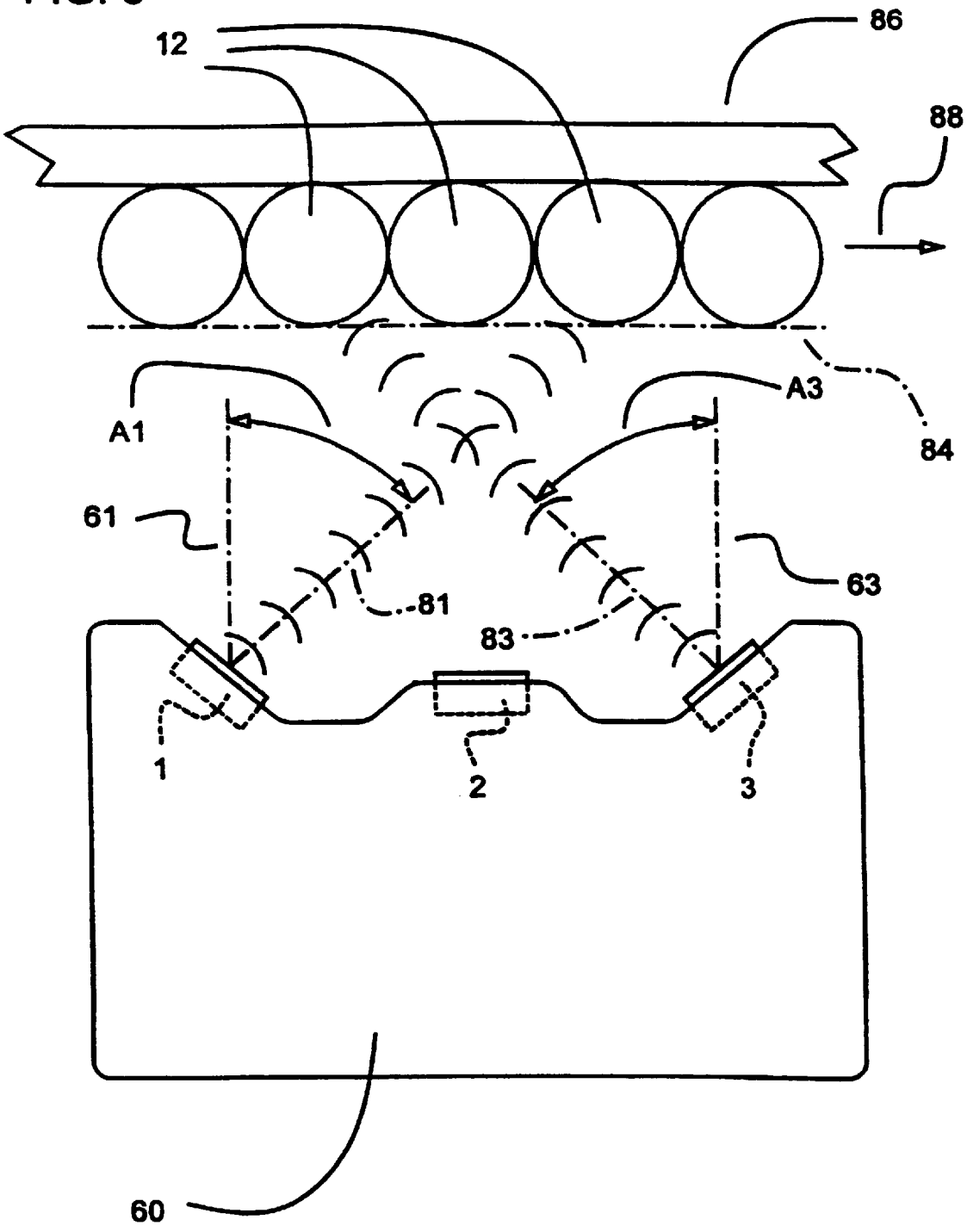
FIG. 5 is a top plan view of an article counting system utilizing two ultrasonic sensors.

The invention described above with reference to FIG. 2 may be extended to a two-transducer arrangement as illustrated in FIG. 5. For that arrangement article distance differences are cumulated and separately queued for the two transducers. This enables verification of the count. Count adjustment signals are generated when corresponding difference accumulations appear in the queues for different transducers.

Referring now to FIG. 5 the two-transducer arrangement will be discussed. As illustrated therein, two counting transducers 1 and 3 are built into a cartridge 60 and generate a pair of inwardly toed ultrasonic beams 81, 83. A third transducer, indicated by the reference number 2, is provided for jam and proximity detection and will not be discussed further herein. Transducers 1, 3 view a progression of articles 12 arranged against a backboard 86 and traveling in direction 88 along a pass line 84. Transducer 3 views the articles 12 during their approach, and transducer 1 views them during their departure. This is so, because beam 81 is angled at an angle A1 of approximately −40 degrees relative to a perpendicular line 61 while beam 83 is directed at an angle A3 of approximately +40 degrees relative to a perpendicular line 63.

Beams 81, 83 are pulsed on for 4–16 microseconds in alternating 1 millisecond intervals so as not to interfere with each other. The sound carrier frequency is above 200 KHz and preferably about 500 Khz. Sound waves at this frequency are highly attenuated in air. Therefore second trip echoes are avoided even at relatively short distances.

Figure 6:
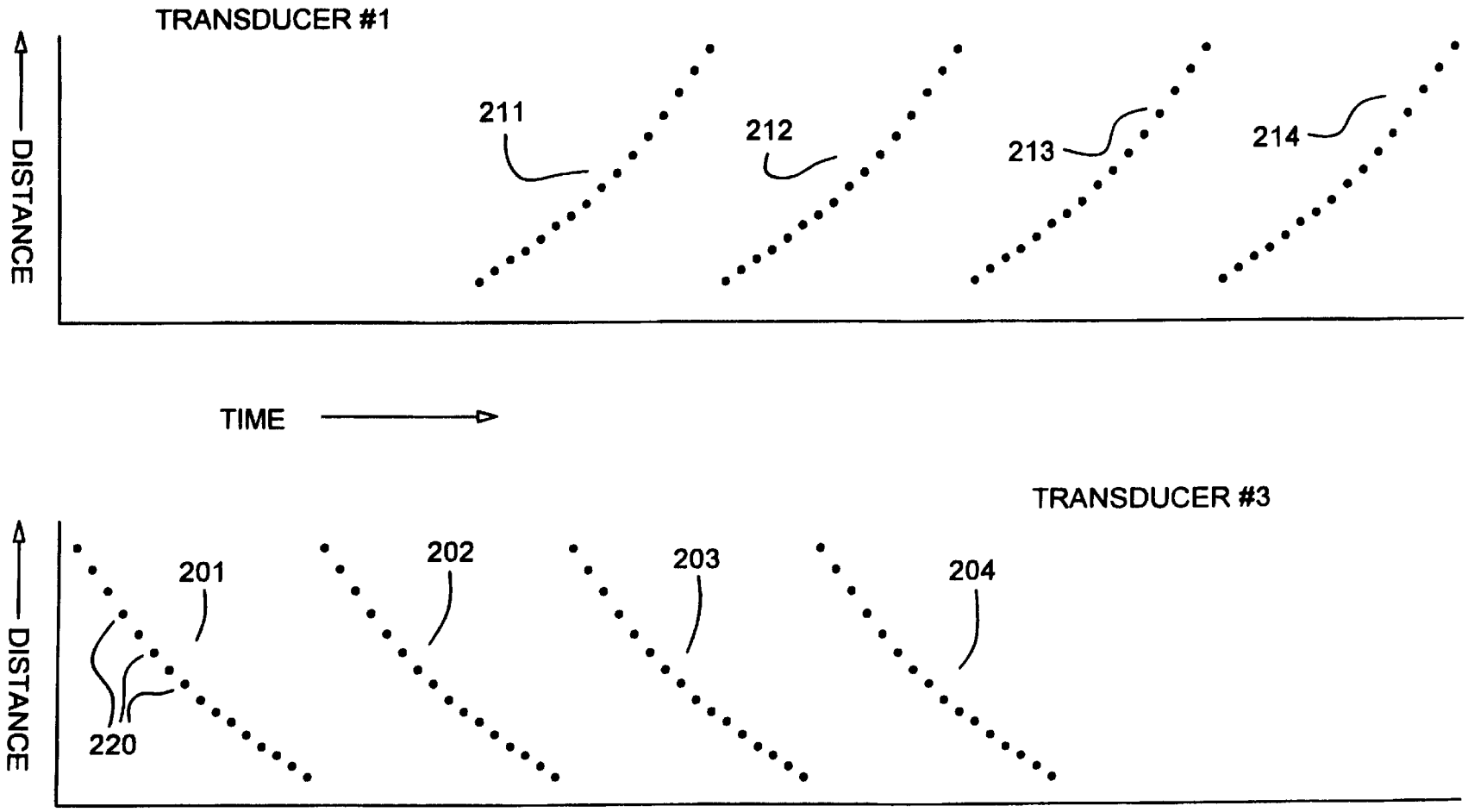
FIG. 6 is a schematic plot of target distance signatures for a series of articles being counted by the embodiment of FIG. 5.

FIG. 6 illustrates a sequence of 4 distance signatures 201–204 for four containers as observed by transducer #3 and a series of 4 distance signatures 211–214 as observed by transducer #1 for the same four articles. It will be observed that the distance signatures 211–214 are displaced in time with respect to the distance signatures 201–204. Each distance signature is characterized by a series of spaced bursts 220 as beams 81, 83 are switched on and off.

Figure 4:
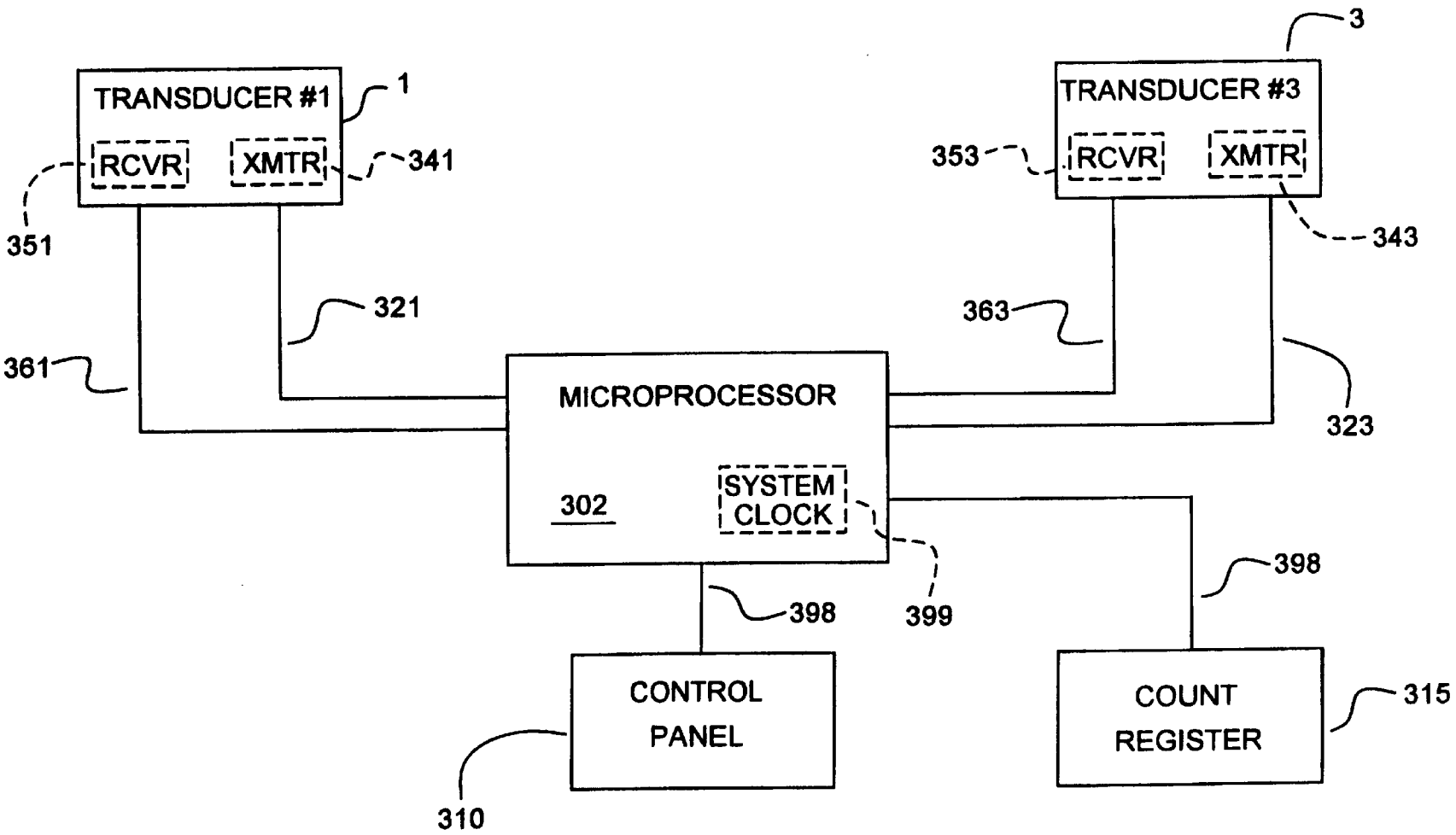
FIG. 4 is a schematic block diagram of apparatus for article counting.

A block diagram illustrating the major electronic components for a two-transducer version of the invention is shown in FIG. 4. Included therein is a microprocessor 302 housing a system clock 399 which provides timing signals for measuring the round trip travel of ultrasonic pulses generated on an alternating basis by transmitters 341 and 343 of transducers 1 and 3 respectively, under control of microprocessor 302 via control lines 321 and 323. Echoes which are returned by target objects are received by receivers 351 and 353 of transducers 1 and 3 respectively. The returning echoes are processed by receivers 351, 353, digitized and relayed to microprocessor 302 by connection lines 361, 363. Microprocessor 302 processes the signals on line 361, 363 as appropriate for generation of count incrementing and decrementing signals which are relayed to a count register 315 by a line 398. It will be appreciated that count register 315 may be any type of count indicating device and that the incrementation thereof may be performed inside microprocessor 302. A control panel 310 accepts manually generated setup parameters and transmits them to microprocessor 302 via a cable indicated by a line 398.

TABLE I presents a structured English description of the program which is executed by microprocessor 302, beginning with a description of the terminology employed. As described in the table, there is an Executive routine which reads echo data from transducers 1 and 3 on an alternating basis under control of system interrupts. Processing of data from one transducer proceeds simultaneously with reading of data from the other. Table I speaks of distances rather than round trip echo travel times, but this is merely a matter of convenience. It will be understood that travel times and distances are proportional, and may be used interchangeably.

The Executive routine begins by calling a subroutine CNTPRC_INIT, which initializes all variables. Thereafter the Executive routine reads echo data from the two transducers. It will be seen that echo distances are temporarily stored in a 3×1 array ScanEchoPostn[n] which may have index values 0 or 2. ScanEchoPostn[0] stores the most recent echo data from transducer 1, and ScanEchoPostn[2] stores the most recent echo data from transducer 3. After the Executive routine stores an echo distance, it changes the index value for ScanEchoPostn[n], calls a subroutine CNTPRC( ) and reads a new echo distance. The process repeats endlessly.

CNTPRC( ) is a subroutine for processing the echo data. Each pass through the subroutine, the microprocessor copies the most recent echo data to a variable, ThisPostn, compares it with the previous value for the same transducer (stored in LastPrcPostn[ ]) and finds the difference, DiffDist. The values of DiffDist are cumulated in two array variables, Accum[O].MoveDist (for transducer 1) and Accum[1] .MoveDist (for transducer 3). Two other array variables, NoEchoCnt[0] and NoEchoCnt[1] are used for counting strings of non-echoes which follow an echo detection.

In an ideal case, as a container approaches transducer 3, DiffDist and Accum[1] are both negative. This condition obtains until the container begins to leave the sonic beam and is replaced by a new container. At that instant DiffDist goes temporarily positive, and the program deduces that it may be appropriate to increment a count variable known as CntainerCount. However, before doing so, the microprocessor calls a subroutine CNTCHK for approval of the count incrementation action. In like manner the microprocessor calls CNTCHK when DiffDist goes temporarily negative for a positive Accum[0].MoveDist. In the event that either of NoEchoCnt[0] or NoEchoCnt[1] reaches a value of 100 the program makes a preliminary assessment that a lone container has passed through the beam and should be counted. This also leads to an approval call to CNTCHK.

In a real world case the containers may back up, stop and even reverse direction. The CNTCHK subroutine deals with these anomolies by queueing and comparing values of Accum[1].Mov.Dist and Accum[0].MoveDist. After CNTCHK has approved a count modification, it calls another subroutine, MAKECNT(Rcvrlndx, Move,Dist) to adjust the value of ContainerCount. As described in table I the program can count both forward and backward, so that if there is a temporary reversal of the container movement, the value of ContainerCount decreases.

TABLE I

```
Terminology

|                Signifies a bitwise OR operation
&                Signifies a bitwise AND operation
xxx[n]           In variable definition, this defines an array xxx of n elements. Index as 0
to n-1
                 In processing, this refers to index n of array xxx
xxx.zzz          In variable definition, this says element zzz belongs to structure xxx.
                 In processing, this refers to element zzz of structure xxx.
xxx[n].zzz       In variable definition, this says element zzz belongs to a structure xxx
                 which is an array.
                 In processing, this refers to element zzz at index n of structure array xxx.
Rcvr is used in place of transducer, in order to reduce the length of variable names
    RcvrIndx is 0 for transducer 1, and 1 for transducer 3.
Postn refers to the distance from the transducer face to the container
Dist refers to the distance that the echo positions have been tracked
************************
Count - Variables
ScanRcvrNum        Receiver being scanned
PrcRcvNum          Receiver being processed by CNTPRC
ScanEchoPostn[3]   Last echo distance for indicated transducer. Program uses array
                   index 0 for echo data from transducer 1 and array index 2 for
                   echo data from transducer 3.
                   Array index 1 is not used.
ThisRcvrIndx       Index for transducer for which an echo distance is currently
                                 available.
OtherRcvrIndx      Index for other transducer
*
* During processing, the move differences are accumulated in Accum[n].MoveDist, and the nearest
* echo
* position is savedin Accum[n].NearPostn. When a break in echo occurs, theMoveDist and
NearPostn are
* shifted through the queues and acted upon when they reach Qued4
Accum[2].MoveDist     Accumlated move distance
Accum[2].NearPostn    Nearest echo distance. Invalid move if not close to pass line
Qued1[2].MoveDist     First queue of move distances
Qued1[2].NearPostn    First queue of newest echo distances
Qued2[2].MoveDist     Second queue of move distances
Qued2[2].NearPostn    Second queue of nearest echo distances
Qued3[2].MoveDist     Third queue of move distances
Qued3[2].NearPostn    Third queue of nearest echo distances
Qued4[2].MoveDist     Fourth queue of move distances
Qued4[2].NearPostn    Fourth queue of nearest echo distances
LastprcPostn[2]       Last processed echo position for each tansducer. Updated at exit
of processing
AccumDist[2]          Accumulated move distance for each transducer.
NoEchoCnt[2]          No echo counter for each transducer
ClearQueueFig[2]      Flag to clear queues. Set non-zero after 100 non echoes
                      (After 25 non-echoes, Accum arrays get processed)
DiffDist              Movement since the last scan for this rcvr
ContainerCounter      Count of containers
*
*    The following variables are set at initialization and not changed againe
*
PassLinePostn[2]      The distance from transducer to pass line
NextCanDist           The distance that qualifies as a jump to next container
GoodMoveDist          The distance that qualifies as a good move string
PoorMoveDist          The distance that qualifies as poor move string
DirectionFlg          Specifies left-to-right or right-to-left
************************
EXECUTIVE ROUTINE
Call CNTPRC_INIT              * Initialize count processing
*
*    Scan and process each Rcvr sequentially
*
     ScanRcvrNum = 1
     Start scan cycle for ScanRcvrNum
     DO
```

TABLE I-continued

```
        Wait for end of scan for ScanRcvrNum
        If Received an echo
        ScanEchoPostn[ScanRcvrNum-1] = Current Echo Distance
        Else
        ScanEchoPostn[ScanRcvrNum-1] = 0            * no echo
        PrcRcvrNum = ScanRcvrNum
        IF (ScanRcvrNum = 3)
        ScanRcvrNum = 1
        ELSE
        ScanRcvrNum = 3
        ENDIF
*
*    Processing required for getting an echo distance from RcvrNum is done by interrupts.
*
     Start scan cycle for ScanRvrNum
*
* While collecting the echo distance for ScanRcvrNum with interrupts, the
* the echo distance from the just completed Rcvr (PrcRcvrNum) is processed
*
     Call CNTPRC()
WHILE (Forever)
*************************
SUBROUTINE CNTPRC_INIT
*
*    initialize count processing
*
     Zero all variables
     Initialize NextCanDist, GoodMoveDist, and PoorMoveDist for container size and shape
     Initialize DirectionFlg based on selected direction
     PassLinePostn[0] = Nearest distance from rcvrl to container along pass line
     PassLinePostn[1] = Nearest distance from rcvr3 to container along pass line
     Return
ENDSUB - CNTPRC_INIT
*************************
SUBROUTINE CNTPRC()
*
*    Process ScanEchoPostn for PrcRcvrNum
*
     IF (PrcRcvrNum = 1)
       ThisRcvrIndx = 0
       OtherRcvrIndx = 1
     ELSE
       IF (PrcRcvrNum = 3)
         ThisRcvrIndx = 1
         OtherRcvrIndx = 0
       ELSE
         Return              * PrcRcvrNum 2
       ENDIF
     ENDIF
*
     ThisPostn = ScanEchoPostn[PrcRcvrNum-1]
*
*    If ThisPostn is zero, then just update LastPrcPostn, and do no echo processing
     IF (ThisPostn = 0)
       NoEchoCnt[ThisRcvrIndx] = NoEchoCnt[ThisRcvrIndx + 1]
       GOTO CNTPRC_NOUPD_LAST
     ENDIF
*
*    Current reading is a valid echo, clear NoEchoCnt, NoEchoActive, and ClearQueueFlg
*
     NoEchoCnt[ThisRcvrIndx] = 0
     ClearQueueFlg[ThisRcvrIndx] =0;
*
*    If do not have a valid LastPrcPostn, just update LastPrcPostn
*
     IF (LastPrcPostn[ThisRcvrIndx] = 0)
       GOTO CNTPRC_UPD_LAST
     ENDIF
     DiffDist = ThisPostn - LastPrcPostn[ThisRcvrIndx]
     IF (DiffDist = 0)
       GOTO ACCUM_UPD_CONT
     ENDIF
*
*    Continue processing based on movement
*
     IF (DiffDist > 0)
       IF (Accum[ThisRcvrIndx].MoveDist > 0)
*
*          Plus movement and plus accumulation so continue accumulation
```

TABLE I-continued

```
*
          Accum[ThisRcvrIndx].MoveDist = Accum[ThisRcvrIndx].MovrDist + DiffDist
          IF (Accum[ThisRcvrIndx].NearPostn = 0 .OR. ThisPostn < Accum[ThisRcvrIndx].
                                NearPostn)
            Accum[ThisRcvrIndx].NearPostn = ThisPostn
          ENDIF
        ELSE
*
*         Plus movement with minus accumulation so check for next container
*
        IF (DiffDist >NextCanDist)
          CALL CNTCHK
        ELSE
*
*         Remove minus direction movement from plus accumulation
*
          Accum[ThisRcvrIndx].MoveDist = Accum[ThisRcvrIndx].MoveDist - DiffDist
          IF (Accum[ThisRcvrIndx].NearPostn = 0.OR. ThisPostn < Accum[ThisRcvrIndx].
                                NearPostn)
            Accum[ThisRcvrIndx].NearPostn = ThisPostn
          ENDIF
        ENDIF
      ELSE          * if (DiffDist > 0
*
*       Have a minus movement. Check accumulation direction
*
        IF (Accum[ThisRcvrIndx].MoveDist < 0)
*
*       Minus movement and minus accumulation so continue accumulation
*
        Accum[ThisRcvrIndx).MoveDist = Accum[ThisRcvrIndx].MoveDist + DiffDist
        IF (Accum[ThisRcvrIndx].NearPostn = 0.OR. ThisPostn < Accum[ThisRcvrIndx].
                                NearPostn)
          Accum[ThisRcvrIndx].NearPostn = ThisPostn
        ENDIF
      ELSE
*
*         Minus movement with plus accumulation so check for next container
*
          IF ( -DiffDist > NextCanDist)
            CALL CNTCHK
          ELSE
*
*         Remove minus direction movement from minus accumulation
*
          Accum[ThisRcvrIndx].MoveDist = Accum[ThisRcvrIndx].MoveDist - DiffDist
          IF (Accum[ThisRcvrIndx].NearPostn = 0.OR. ThisPostn < Accum[ThisRcvrIndx].
                                NearPostn)
            Accum[ThisRcvrIndx].NearPostn = ThisPostn
          ENDIF
        ENDIF
      ENDIF           *if (DiffDist > 0
CNTPRC__UPD__LAST:
*
*     Update last processed echo for this Rcvr
*
      IF (ThisPostn <> 0)
        LastPrcPostn[ThisRcvrIndx] = ThisPostn
      ENDIF
CNTPRC__NOUPD__LAST:
*
*     If more than 25 no echoes from each Rcvr, then process current accumulations.
*     After 100 non-echoes, then clear the queues
*
      IF (NoEchoCnt[ThisRcvrIndx] >= 25.AND.NoEchoCnt[OtherRcvrIndx] >= 25)
        If (NoEchoCnt[ThisRcvrIndx] > 100.AND.NoEchoCnt[OtherRcvrIndx> 100)
          ClearQueueFlg[ThisRcvrIndx] = 1
        ENDIF
        Call CNTCHK
      ENDIF * if(NoEchoCnt[ThisRcvrIndx] >= 25.AND. NoEchoCnt[OtherRcvrIndx] > 25)
      RETURN
ENDSUB CNTPRC
*****************************************************************
SUBROUTINE CNTCHK
*
*     This routine is called when a jump to next can is detected or when clearing queues because of no
*     echoes.
*     This subroutine must clear Accum[ThisRcvrIndx] arrays before returning, so another move string
*     can begin.
```

TABLE I-continued

```
*    Normally this is done by matching up a Qued4[ThisRcvrIndx] with either Qued4[OtherRcvrIndx]
*    or
*    Qued3[OtherRcvrIndx], making a change in count, and then clearing the queued entries used
*    to make the count. However many exceptions to this processing occur.
*
*    If clearing queues is active, then the queues get shifted up until they are all zero
*    (After 25 non-echoes, the data in the Accum arrays are processed)
*
     IF (ClearQueueFlg[ThisRcvrIndx] = 0
*
*      Not clearing queues. Throw away small accumulations
*
       IF (Accum[ThisRcvrIndx].MoveDist <> 0)
         IF (ABS(Accum[ThisRcvrIndx].MoveDist) < SMALL_DIST)
           Clear Accum[ThisRcvrIndx] arrays
           GOTO CNTCHK_RET
         ENDIF
       ELSE
*
*        zero accumulation, so no processing
*
         GOTO CNTCHK_RET
       ENDIF
     ENDIF * if (ClearQueueFlg[ThisRcvrIndz]
*
*    If Qued4[ThisRcvrIndx] array empty, then just shift the queues
*
     IF (Qued4.[ThisRcvrIndx].MoveDist = 0)
       Move Qued3[ThisRcvrIndx] arrays to Qued4[ThisRcvrIndx] arrays
       Move Qued2[ThisRcvrIndx] arrays to Qued3[ThisRcvrIndx] arrays
       Move Qued1[ThisRcvrIndx] arrays to Qued2[ThisRcvrIndx] arrays
       Move Accum[ThisRcvrIndx] arrays to Qued1[ThisRcvrIndx] arrays
       Clear Accum[ThisRcvrIndx] Arrays
       GOTO CNTCHK_RET
     ENDIF
*
*    Qued4[ThisRcvrIndx] not empty. If Qued3[ThisRcvrIndx] array empty, then just shift queues
*
     IF (Qued3[ThisRcvrIndx].MoveDist = 0)
       Move Qued2[ThisRcvrIndx] arrays to Qued3[ThisRcvrIndx] arrays
       Move Qued1[ThisRcvrIndx] arrays to Qued3[ThisRcvrIndx] arrays
       Move Accum[ThisRcvrIndx] arrays to Qued1[ThisRcvrIndx] arrays
       Clear Accum[ThisRcvrIndx] arrays
       GOTO CNTCHK_RET
     ENDIF
*
*    If Qued4[ThisRcvrIndx] entry not close to pass line, then delete Qued4[ThisRcvrIndx] entry by
*    shifting queues
*
     IF (Qued4[ThisRcvrIndx].Nearpostn not close to PassLinePostn[ThisRcvrIndx])
       Clear Qued4[ThisRcvrIndx] arrays
       Move Qued3[ThisRcvrIndx] arrays to Qued4[ThisRcvrIndx] arrays
       Move Qued2[ThisRcvrIndx] arrays to Qued3[ThisRcvrIndx] arrays
       Move Qued1[ThisRcvrIndx] arrays to Qued2[ThisRcvrIndx] arrays
       Move Accum[ThisRcvrIndx] arrays to Qued1[ThisRcvrIndx] arrays
       Clear Accum[ThisRcvrIndx] arrays
       GOTO CNTCHK_RET
     ENDIF
*
*    Check if Qued3[ThisRcvrIndx] and Qued4[ThisRcvrIndx] entries have opposite directions
*
     IF (Direction for Qued3[ThisRcvrIndx] not same direction as Qued4[ThisRcvrIndx])
*
*      If either move distance, 3 times greater than the other, delete smaller
*
       IF (3 *ABS(Qued3[ThisRcvrIndx].MoveDist) < ABS(Qued4[ThisRcvrIndx].MoveDist) )
         Clear Qued3[ThisRcvrIndx] arrays
         Move Qued2[ThisRcvrIndx] arrays to Qued3[ThisRcvrIndx] arrays
         Move Qued1[ThisRcvrIndx] arrays to Qued2[ThisRcvrIndx] arrays
         Move Accum[ThisRcvrIndx] arrays to Qued1[ThisRcvrIndx] arrays
         Clear Accum[ThisRcvrIndx] arrays
         GOTO CNTCHK_RET
       ENDIF
       IF(3* ABS(Qued4[This RcvrIndx].MoveDist) < ABS(Qued3[ThisRcvrIndex].MoveDist) )
         Clear Qued4[ThisRcvrIndx] arrays
         Move Qued3[ThisRcvrIndx] arrays to Qued4[ThisRcvrIndx] arrays
         Move Qued2[ThisRcvrIndx] arrays to Qued3[ThisRcvrIndx] arrays
         Move Qued1[ThisRcvrIndx] arrays to Qued2[ThisRcvrIndx] arrays
         Move Accum[ThisRcvrIndx] arrays to Qued1[ThisRcvrIndx] arrays
```

TABLE I-continued

```
        Clear Accum arrays
        GOTO CNTCHK_RET
      ENDIF
*
*     Neither is 3 times greater than the other, so delete both Qued3 & Qued4
*
      Clear Qued4[ThisRcvrIndx] arrays
      Clear Qued3[ThisRcvrIndx] arrays
      Move Qued2[ThisRcvrIndx] arrays to Qued3[ThisRcvrIndx] arrays
      Move Qued1[ThisRcvrIndx] arrays to Qued2[ThisRcvrIndx] arrays
      Move Accum[ThisRcvrIndx] arrays to Qued1[ThisRcvrIndx] arrays
      Clear Accum arrays
      GOTO CNTCHK_RET
    ENDIF
*
*   Have a Qued4 and Qued3 entry for this rcvr that are for same direction.
*   Try to find a matching move for the other rcvr
*
*   Program can loop back here after deleting or adjusting the queues
*
CNTCHK_TRYAGAIN:
    IF (Qued4[OtherRcvrIndx].MoveDist <> 0)
      GOTO HAVE_QUED4_BOTH        *Branch to process qued4 for both rcvr's
    ENDIF
*
*   Do not have a Qued4 for the other rcvr
*   If not doing Clear Queue processing for either rcvr, check Qued3[OtherRcvrIndx]
*   (If clearing Queues, Qued3 will get shifted into Qued4 eventually.)
*
    IF (ClearQueueFlg[ThisRcvrIndx] <> 0.OR.ClearQueueFlg[OtherRcvrIndx] <> 0)
      GOTO CNTPRC_RET
    ENDIF
    IF (Qued3[OtherRcvrIndx].MoveDist <> 0)
      Move Qued3[OtherRcvrIndx] arrays to Qued4[OtherRcvrIndx] arrays
      Clear Qued3[OtherRcvrIndx] arrays
      GOTO HAVE_QUED4_BOTH
    ENDIF
*
*   Have neither Qued4[OtherRcvrIndx] or Qued3[OtherRcvrIndx],
*   Check if Qued2[ThisRcvrIndx] can cancel Qued3[ThisRcvrIndx]
    IF (Qued2[ThisRcvrIndx].MoveDist = 0)
*
*     No Qued2[ThisRcvrIndx] so just shift queues which clears up Accum arrays
*
      Move Qued1[ThisRcvrIndx] arrays to Qued2[ThisRcvrIndx] arrays
      Move Accum[ThisRcvrIndx] arrays to Qued1[ThisRcvrIndx] arrays
      Clear Accum[ThisRcvrIndx] arrays
      GOTO CNTCHK_RET
    ENDIF
*
*   Have Qued2[ThisRcvrIndx] and Qued3[ThisRcvrIndx].
*   If Qued2[ThisRcvrIndx] opposite direction of Qued3[ThisRcvrIndx] and valid move, then can
      clear q2 & q3.
*
    IF (Direction of Qued2[ThisRcvrIndx] opposite direction of Qued3[ThisRcvrIndx])
      If (ABS(Qued2[ThisRcvrIndx].MoveDist) > PoorMoveDist)
        Clear Qued3[ThisRcvrIndx] arrays
        Clear Qued2[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        GOTO CNTCHK_RET
      ENDIF
    ENDIF
*
*   Have Q2, Q3, & Q4 for ThisRcvrIndx that agree on direction, and no Q3 or Q4 for
        OtherRcvrIndx
*   Check Q2 for OtherRcvrIndx
*
    IF (Qued2[OtherRcvrIndx].MoveDist <> 0)
      Move Qued2[OtherRcvrIndx] arrays to Qued4[OtherRcvrIndx] arrays
      Clear Qued2[OtherRcvrIndx] arrays
      GOTO HAVE_QUED4_BOTH
    ENDIF
*
*   Have Q2, Q3, Q4 for ThisRcvrIndx agree on direction, and no Q2, Q3, or Q4 for OtherRcvrIndx
*   Check that Q4[ThisRcvrIndx], Q3[ThisRcvrIndx], and Q2[ThisRcvrIndx] are all good moves
*
    IF (ABS(Qued4[ThisRcvrIndx].MoveDist) < PoorMoveDist)
```

TABLE I-continued

```
*
*       Delete Qued4[ThisRcvrIndx] which is a poor move
*
        Clear Qued4[ThisRcvrIndx] arrays
        Move Qued3[ThisRcvrIndx] arrays to Qued4[ThisRcvrIndx] arrays
        Move Qued2[ThisRcvrIndx] arrays to Qued3[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        GOTO CNTCHK_RET
    ENDIF
    IF (ABS(Qued3[ThisRcvrIndx].MoveDist) < PoorMoveDist)
*
*       Delete Qued3[ThisRcvrIndx] which is a poor move
*
        Clear Qued3[ThisRcvrIndx] arrays
        Move Qued2[ThisRcvrIndx] arrays to Qued3[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        GOTO CNTCHK_RET
    ENDIF
    IF (ABS(Qued2[ThisRcvrIndx].MoveDist) <PoorMoveDist)
*
*       Delete Qued2[ThisRcvrIndx] which is a poor move
*
        Clear Qued2[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        GOTO CNTCHK_RET
    ENDIF
*
*   Make count based on Qued4[ThisRcvrIndx] alone
*
    CALL MAKECNT(ThisRcvrIndx, Qued4[ThisRcvrIndx].MoveDist)
    Clear Qued4[ThisRcvrIndx] arrays
    Move Qued3[ThisRcvrIndx] arrays to Qued4[ThisRcvrIndx] arrays
    Move Qued2[ThisRcvrIndx] arrays to Qued3[ThisRcvrIndx] arrays
    Move Qued1[ThisRcvrIndx] arrays to Qued2[ThisRcvrIndx] arrays
    Move Accum[ThisRcvrIndx] arrays to Qued1[ThisRcvrIndx] arrays
    Clear Accum[ThisRcvrIndx] arrays
    GOTO CNTCHK_RET
HAVE_QUED4_BOTH:
*
*   Have Qued4[ThisRcvrIndx], Qued3[ThisRcvrIndx], and Qued4[OtherRcvrIndx]
*
    IF (Qued4[OtherRcvrIndx].NearPostn not close to PassLinePostn[OtherRcvrIndx])
        Clear Qued4[OtherRcvrIndx] arrays
        GOTO CNTCHK_TRYAGAIN
    ENDIF
    IF (direction of Qued4[ThisRcvrIndx] agrees with direction of Qued4[OtherRcvrIndx])
*
*       Rcvrs agree on direction so make count
*
        CALL MAKECNT(ThisRcvrIndx, Qued4[ThisRcvrIndx].MoveDist)
        Clear Qued4[ThisRcvrIndx] arrays
        Move Qued3[ThisRcvrIndx] arrays to Qued4[ThisRcvrIndx] arrays
        Move Qued2[ThisRcvrIndx] arrays to Qued3[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        Clear Qued4[OtherRcvrIndx] arrays
        GOTO CNTCHK_RET
    ELSE
*
*   ThisRcvrIndx and OtherRcvrIndx disagree on the direction.
*   Check if Qued2[ThisRcvrIndx] can cancel out Qued3[ThisRcvrIndx] which will
*   clear Accum array
*
    IF (direction of Qued2[ThisRcvrIndx] opposite direction of Qued3[ThisRcvrIndx])
        IF (ABS(Qued2[ThisRcvrIndx].MoveDist) > PoorMoveDist)
            Clear Qued3[ThisRcvrIndx] arrays
            Clear Qued2[ThisRcvrIndx] arrays
            Move Qued1[ThisRcvrIndx] arrays to Qued2[ThisRcvrIndx] arrays
            Move Accum[ThisRcvrIndx] arrays to Qued1[ThisRcvIndx] arrays
            Clear Accum[ThisRcvrIndx] arrays
        ENDIF
    ENDIF
```

TABLE I-continued

```
*
*    Check if Qued3[OthrRcvr] disagrees with Qued4[OthrRcvr],
*    If so delete Qued3[OtherRcvrIndx] and Qued4[OtherRcvrIndx], which will next test
*    direction of Qued4[ThisRcvrIndx] with direction of Qued2[OtherRcvrIndx]
*
     IF (direction of Qued3[OtherRcvrIndx] opposite direction of Qued4[OtherRcvrIndx])
        Clear Qued4[OtherRcvrIndx] arrays
        Clear Qued3[OtherRcvrIndx] arrays
        Move Qued2[OtherRcvrIndx]arrays to Qued4[OtherRcvrIndx] arrays
        Clear Qued2[OtherRcvrIndx] arrays
        GOTO CNTCHK_TRYAGAIN
     ENDIF
*
*    Still have a Qued4[ThisRcvrIndx] disagreeing with direction of Qued4[OtherRcvrIndx]
*    If one twice as good as other, make count based on larger; otherwise delete both
*
     IF (2*ABS(Qued4[OtherRcvrIndx].MoveDist) < ABS)Qued4[ThisRcvrIndx].MoveDist) )
        CALL MAKECNT(ThisRcvrIndx, Qued4[ThisRcvrIndx].MoveDist)
        Clear Qued4[OtherRcvrIndx] arrays
        Clear Qued4[ThisRcvrIndx] arrays
        Move Qued3[ThisRcvrIndx] arrays to Qued4[ThisRcvrIndx] arrays
        Move Qued2[ThisRcvrIndx] arrays to Qued3[ThisRcvrIndx] arrays
        Move Qued1[ThisRcvrIndx] arrays to Qued2[ThisRcvrIndx] arrays
        Move Accum[ThisRcvrIndx] arrays to Qued1[ThisRcvrIndx] arrays
        Clear Accum[ThisRcvrIndx] arrays
        GOTO CNTCHK_RET
     ENDIF
     IF (2*ABS(Qued4[ThisRcvrIndx].MoveDist) < ABS(Qued4[OtherRcvrIndx].MoveDist) )
        CALL MAKECNT(OtherRcvrIndx, Qued4[OtherRcvrIndx].MoveDist)
        Clear Qued4[OtherRcvrIndx] arrays
        Clear Qued4[ThisRcvrIndx] arrays
     ENDIF
CNTCHK_RET:
     RETURN
ENDSUB CNTCHK-
*************************************
SUBROUTINE MAKECNT(RcvrIndx, MoveDist)
*
*    Make plus or minus count based on DirectionFlg, RcvrIndx, and sign of MoveDist
*
     If (DirectionFlg is Left-to-Right)
*
*       Direction is left-to-right. Plus count is moving away from rcvr 1
*
        IF (RcvrIndx = 1)
           IF (MoveDist > 0)
              ContainerCount = ContainerCount + 1
           ELSE
              ContainerCount = ContainerCount - 1
           ENDIF
        ELSE
           IF (MoveDist < 0)
              ContainerCount = ContainerCount + 1
           ELSE
              ContainerCount = ContainerCount - 1
           ENDIF
        ENDIF
     ELSE
*
*
*    Direction is right-to-left. Plus count is moving away from rcvr 3
*
        IF (RcvrIndx = 1)
           IF (MoveDist > 0)
              ContainerCount = ContainerCount - 1
           ELSE
              ContainerCount = ContainerCount + 1
           ENDIF
        ELSE
           IF (MoveDist < 0)
              ContainerCount = ContainerCount + 1
           ELSE
              ContainerCount = ContainerCount - 1
           ENDIF
        ENDIF
     ENDIF
ENDSUB MAKECNT
              ****************************
```

While the forms of apparatus and the methods of operation herein described constitute preferred embodiments of this invention, it is to be understood that the invention is not limited to these precise embodiments, and that changes may be made therein without departing from the scope of the invention which is defined in the appended claims.

What is claimed is:

1. Apparatus for counting a progression of moving articles comprising:

an ultrasonic transducer comprising a transmitter for directing a beam of ultrasonic energy angularly toward said progression of articles and a receiver for receiving ultrasonic energy reflected backwardly toward said transducer by said articles, timing means for measuring the round trip travel time of ultrasonic energy forwardly from said transmitter to said articles and reversely from said articles to said receiver, a computer connected to said timing means for detecting progressive changes in said round trip travel time corresponding to movement of an article through said beam and also detecting abrupt changes in said round trip travel time due to entry of new articles into said beam, said computer being configured for generating count adjustment signals upon occurrence of said abrupt changes happening after periods of said progressive changes, and a count indicator responsive to said count adjustment signals for registering a count of said articles.

2. Apparatus according to claim 1 further comprising means within said computer for generating count adjustment signals upon persistence of a no-echo condition for a predetermined period of time following reception of echoes.

3. A method of counting a spaced progression of moving articles comprising the steps of:

(1) directing pulses of ultrasonic energy from a point of origination toward said progression of articles along a beam axis having an angular orientation such that said articles pass through said beam at a distance from said point of origination which changes progressively by non-zero amounts, and reflect echoes of said pulses echoes backwardly toward said point of origination, (2) measuring the round-trip travel times of said pulses along said beam axis from said point of origination to ones of said articles passing through said beam, and (3) generating count adjustment signals upon the occurrence of abrupt changes in said round-trip travel time.

4. A method according to claim 2 wherein said pulses are generated at a carrier frequency high enough for attenuation in air by a sufficient amount to prevent detection of ones of said pulses which have made two round trips between said point of origination and a said article passing through said beam.

5. A method according to claim 4 wherein said pulses are generated at a carrier frequency of about 500 KHz.

6. A method of counting a spaced progression of moving articles comprising the steps of:

(1) directing a first series of pulses of ultrasonic energy from a first point of origination toward said progression of articles along a first beam axis having an angular orientation such that said articles pass through said first beam at a distance from said first point of origination which progressively decreases, and reflect echoes of said first series of pulses backwardly toward said first point of origination, (2) directing a second series of pulses of ultrasonic energy from a second point of origination toward said progression of articles along a second beam axis having an angular orientation such that said articles pass through said second beam at a distance from said second point of origination which progressively increases, and reflect echoes of said second series of pulses backwardly toward said second point of origination, (3) measuring first round-trip travel times of said first series of pulses, (4) measuring the second round-trip travel times of said second series of pulses, (5) generating count adjustment signals upon the occurrence of abrupt increases in said first round trip travel times and corresponding abrupt decreases in said second round trip travel times, and (6) accumulating said count adjustment signals.

7. A method according to claim 6 wherein said first series of pulses and said second series of pulses are generated on an alternating basis at a common carrier frequency.

8. A method according to claim 7 wherein said carrier frequency is high enough for attenuation in air by a sufficient amount to prevent detection of ones of said pulses which have made two round trips between their respective points of origination and said articles passing through their respective beams.

9. A method according to claim 8 wherein said carrier frequency is about 500 KHz.

10. Apparatus for counting a progression of articles moving in a common direction, said apparatus comprising:

a first ultrasonic transducer comprising a first transmitter for directing a first beam of ultrasonic energy toward said progression of articles at an angle such that said articles have a progressively decreasing distance from said first transducer as they pass through said first beam, and a first receiver for receiving ultrasonic energy reflected backwardly toward said first transducer by said articles, a second ultrasonic transducer comprising a second transmitter for directing a second beam of ultrasonic energy toward said progression of articles at an angle such that said articles have a progressively increasing distance from said second transducer as they pass through said second beam, and a second receiver for receiving sonic energy reflected backwardly toward said second transducer by said articles, timing means for measuring a first round trip travel time of ultrasonic energy between said first transducer and articles in said first beam and a second round trip travel time of ultrasonic energy between said second transducer and articles in said second beam, a computer connected to said timing means for generating count adjustment signals upon occurrences of abrupt increases in said first round trip travel time and corresponding abrupt decreases in said second round trip travel time, and a count indicator responsive to said count adjustment signals for registering a count of said articles.

11. Apparatus according to claim 10 wherein said first transducer and said second transducer are each angled approximately 40 degrees relative to a line extending perpendicular to said common direction.

12. A method of counting a spaced progression of moving articles comprising the steps of:

(1) directing a series of pulses of sonic energy toward said articles from a point of origination which is offset from said progression, (2) receiving echoes of said pulses of sonic energy, (3) measuring travel times for said echoes, (4) calculating travel time differences for said echoes (5) cumulating said travel time differences to create an accumulation thereof, (6) generating a count adjustment signal upon occurrence of a said travel time difference having a numerical sign which is opposite to the numerical sign of said accumulation, (7) generating a count adjustment signal when an echo loss occurs following echo reception and persists for a predetermined period of time, and (8) accumulating said count adjustment signals.

13. Apparatus for counting a progression of articles moving along a common path, said apparatus comprising:

an ultrasonic transmitter directed at an acute angle toward said path;

an ultrasonic receiver positioned and directed to receive echoes of ultrasonic pulses transmitted by said transmitter;

an echo processor programmed to measure travel times of said echoes; and a counter configured to count ones of said echoes which are characterized by abrupt changes in travel time.

* * * * *